United States Patent [19]

Sonefors

[11] Patent Number: 4,989,304

[45] Date of Patent: Feb. 5, 1991

[54] TOOL PLATE FOR ABRASIVE SURFACE SMOOTHING

[75] Inventor: Yngve Sonefors, Bollnäs, Sweden

[73] Assignee: Sandvik AB, Sandviken, Sweden

[21] Appl. No.: 529,735

[22] Filed: May 29, 1990

Related U.S. Application Data

[63] Continuation of Ser. No. 192,478, May 11, 1988, abandoned.

[30] Foreign Application Priority Data

May 15, 1987 [SE] Sweden ..... 8702003

[51] Int. Cl.[5] ..... B24D 11/00; B23D 71/00

[52] U.S. Cl. ..... 29/78; 51/396; 51/398

[58] Field of Search ..... 29/76.1, 76.4, 78; 51/204, 394, 396, 398

[56] References Cited

U.S. PATENT DOCUMENTS

| | | | |
|---|---|---|---|
| 852,873 | 5/1907 | Davidson | 76/84 |
| 2,810,190 | 10/1957 | Schmidgall | 29/78 |
| 3,045,321 | 7/1962 | McDermott | 29/78 |
| 3,869,263 | 3/1975 | Greenspan | 51/204 |
| 4,456,500 | 6/1984 | Ibata | 156/634 |

FOREIGN PATENT DOCUMENTS 60-17648 5/1985 Japan .

*Primary Examiner*—William E. Terrell

*Attorney, Agent, or Firm*—Burns, Doane, Swecker & Mathis

[57] ABSTRACT

An improved abrasive tool plate for surface smoothing of wood, plastic and other soft materials comprises a thin steel plate, on one side of which a pattern of etch fluid resistant material has been applied, followed by etching away the surface between the pattern elements down to a determined depth. Parts of the steel plate protected by the etch fluid resistant material pattern will remain between the etched away parts as protruding elements with flat tops, which can serve as cutting elements. According to the invention, the tool plate is thereafter rolled in multiple steps between one rigid roller with raised parallel strips and on elastically deformable roller to deform the plate so that the etched side shows parallel ridges. Preferably, the ridges are formed in two different directions, so that they form a rhombic pattern.

3 Claims, 1 Drawing Sheet

Fig. 1
(PRIOR ART)
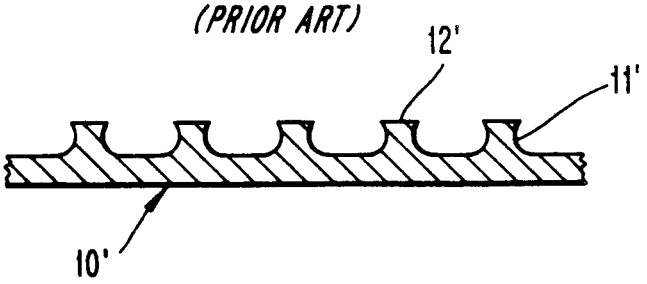
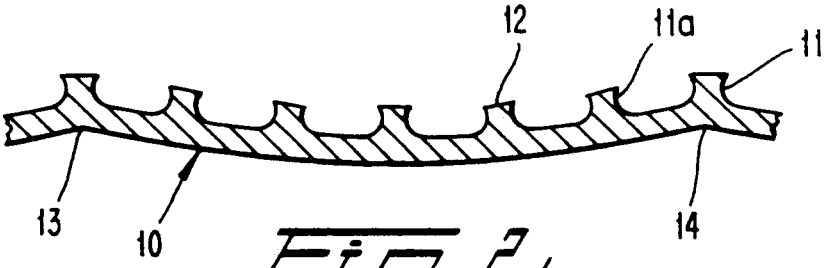
Fig. 2
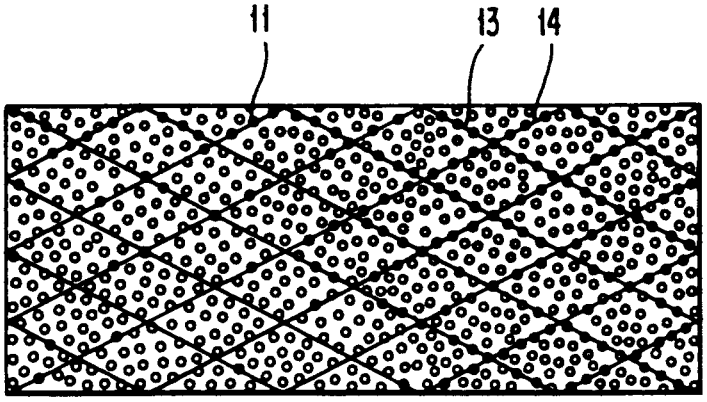
Fig. 3

TOOL PLATE FOR ABRASIVE SURFACE SMOOTHING

This application is a continuation of application Ser. No. 07/192,478, filed May 11, 1988 abandoned.

BACK AND OBJECTS OF THE INVENTION

The invention describes an improved etched abrasive tool plate for surface smoothing, and a method to produce it.

It is previously known to produce tools for abrasive surface smoothing of workpieces of wood, plastics, leather and other soft materials by etching a thin flat steel plate, so that from the original surface of the plate only minor parts remain as flat limited surface portions with round, elongated or polygonal shape. The other parts of the plate surface are by the etching recessed to a lower level. The remaining flat surface portions then form the tips of cutting elements protruding from the recessed etched surface, and shaped like truncated cones or pyramids, as described in U.S. Pat. No. 3,045,321, where the edges of the flat surface portions constitute the cutting edges in abrasive smoothing of the workpiece.

This type of tool plate can produce very smooth surfaces on the workpiece, but requires that the tool be pressed against the workpiece with enough force to cause the cutting elements to penetrate a small distance into the workpiece. For small tools or convex workpieces this poses no problem. For large flat workpieces and large tools, such as orbital sanders the force would be too large to be practical, however.

Different methods have been suggested to facilitate the use of etched tool plates. U.S. Pat. No. 3,045,321 suggests the possibility of etching until the flat surface portions on the tips of the cutting elements become very small or vanish. In such a case, however, one would not achieve a good smooth workpiece surface but a finely scratched, even though flat. Very small tip surfaces would also make it impossible to etch in such a manner that the cutting edge angle becomes less than 90 degrees with the upper portion of the cutting elements hourglass-shaped, as has otherwise proved advantageous, especially to get highest surface smoothness.

Japanese Pat. No. 60-17648 describes that one can perform further etching steps to make the flat surface portions coarse and irregular, which facilitates their penetration into the workpiece. This is only a temporary effect, however, since the surface portions quickly become smooth and flat through wear when used.

The present invention describes an etched tool plate and a tool plate and a method for producing it, where through a special forming operation the load is distributed between the cutting elements in such a way that only a minor number of them carry the full load and at the same time limit the penetration of other cutting elements which are given improved abrading ability by tilting. In this manner large flat tool plates can be manufactured, which simultaneously achieve better surface smoothness, lower forces and better wear resistance than previously known tool plates.

THE DRAWINGS

The invention is described below with reference to the accompanying figures, where FIG. 1 shows a section through an etched tool plate with cutting elements according to known technology, FIG. 2 shows a section through an improved etched tool plate according to the present invention, FIG. 3 shows a plan view of the etched side of an improved tool plate according to the invention.

DESCRIPTION OF A PREFERRED EMBODIMENT OF THE INVENTION

In FIG. 1, a conventional etched cutting plate 10' is depicted wherein cutting elements (11') with flat tip surface portions (12') are shown protruding from a base of the etched tool plate.

To produce an improved tool plate according to the invention, one starts with such a thin flat steel plate, on one side of which a material resistant to etching fluid is applied in a determined pattern such as equal size spots which can be round, elongated or polygonal. The application can be performed through a printing process such as silk-screen printing, or by covering the whole plate with a layer of water-soluble photoresist, which is thereafter hardened by ultra-violet radiation in spots, after which the non-hardened parts of the layer are flushed away. The side of the plate with the resistant pattern is then sprayed with an etching fluid, such as ferric chloride dissolved in water, so that those parts of the surface not protected by the resistant pattern elements are etched away to a determined depth, while those parts protected by the resistant pattern elements remain as protruding cutting elements. Through variation of spraying mode, composition and temperature of the etching fluid one can influence the angle between the side of the protruding cutting elements and the original plate surface, as well as how far under the edge of the protecting pattern elements the etching will reach.

After the etching process and cleaning, the tool plate (10') corresponds to what is known from U.S. Pat. No. 3,045,321 which is usable for surface smoothing but has the drawbacks mentioned above and is not suitable for large flat tools. According to the invention the plate is then rolled twice between one rigid roller with raised parallel strips and one elastically deformable roller made with rubber or polyurethane, with the rigid roller in contact with the unetched backside of the tool plate, and the elastically deformable roller in contact with the etched side. Through this rolling the tool plate is deformed with parallel ridges (13, 14) on the etched side (see FIG. 2). The sharpness of the ridges depends on the width of the parallel strips. After rolling twice in a row producing ridges with different directions, the ridges form a system of rhombic quadrangles, which prevents the plate from curling, as it would if all ridges were in the same direction.

Preferrentially, the longer axis of the rhombic quadrangles should coincide with the lengthwise direction of the tool plate. The distance between ridges (13, 14) should be considerably larger than the distance between the cutting elements (11).

The generally flat tool plate (10) can thereafter be attached to a flat tool plate carrier in known manner such as with glue or with textile fasteners. The tool plate carrier can be used by hand or with a sander machine.

The parallel strips on the roller can be placed tangentially or in a preferred embodiment helically like a thread around the roller. By rolling the first time with a right hand threaded roller and the second time with a left hand threaded roller or vice versa, the rhombic system of ridges is produced during continuous feeding of tool plate in strip form.

The rolling to form ridges has two effects, which together contribute to the superior performance of this tool plate. Those cutting elements (11) which are situated on the crest of the ridges are only a minority of the total number, and are in cutting contact with the workpiece when a low load is placed on the tool plate. Their tip surface portions are parallel to the mean plane of the tool plate and the tool carrier and have limited abrasive capacity, but at low loads they ensure good surface smoothness, and at high loads they carry a major part of the load, and prevent overloading of other cutting elements.

Those cutting elements (11*a*) which are situated on the slopes of the ridges (13, 14) are not in cutting contact with the workpiece until the load on the tool plate is increased, and never themselves carry much of this load. Since they are situated on the slopes of the ridges, their tip surface portions are slightly inclined relative to the mean plane of the tool plate carrier and are inclined to form acute angles with planes defined by the flat tops of the cutting elements 11 situated on the crests of the ridges, as is shown in FIG. 2. The angle of inclination becomes further increased because the forces between the elastic roller and the cutting element during rolling tends to bend the tips of the cutting elements (11*a*) away from the crest of the ridge (13, 14). The cutting elements (11*a*) on the slopes will thus touch the workpiece with the sharp cutting edge of the tip surface portion while the cutting depth is limited by the carrying action of the cutting elements (11) on the crests. In this way one avoids overloading and damage to the cutting elements (11*a*) on the slopes, which retain their sharpness longer.

After long progressive wear the needed load on the tool plate will increase, but not as much as for a tool plate without ridges, and cutting elements situated further down the slopes will gradually take part in the abrasive cutting.

The height of the ridges (13, 14) should be of the same order as the height of the cutting elements (11) or slightly less. Otherwise the cutting elements furthest down the slopes or in the valleys will never be utilized. In practical cases the height of the cutting elements is 0.1 to 0.3 mm.

I claim:

1. Etched tool plate for abrasive surface smoothing of soft materials, comprising a thin metal plate, one side of said metal plate being partly recessed by etching such that non-etched portions of said plate constitute protruding cutting elements having flat tops, said metal plate being slightly deformed from a planar state to define a system of parallel intersecting ridges therein, the deformation of said plate being asymmetric about a mean plane of said plate such that said ridges are relatively sharp in section and delineate valleys which are relatively smooth therebetween a first plurality of said cutting elements being disposed on crests of said ridges with flat tops thereof disposed substantially parallel to said mean plane and a second plurality of said cutting elements being spaced from said crests with the flat tops thereof inclined so as to form acute angles with said mean plane.

2. Etched tool plate according to claim 1, wherein the ridges are linear and uninterrupted along their length.

3. Etched tool plate according to claim 1, wherein each ridge extends linearly from an edge of said plate to another edge thereof.

* * * * *